US006774551B2

(12) United States Patent
Bae et al.

(10) Patent No.: US 6,774,551 B2
(45) Date of Patent: Aug. 10, 2004

(54) TENSION MASK FRAME ASSEMBLY FOR COLOR CRT

(75) Inventors: Joon-soo Bae, Seoul (KR); Kuen-dong Ha, Seongnam (KR); Gui-bae Kim, Suwon (JP); Woo-il Park, Kyungki-do (KR)

(73) Assignee: Samsung SDI Co., Ltd., Suwon-Si (KR)

( * ) Notice: Subject to any disclaimer, the term of this patent is extended or adjusted under 35 U.S.C. 154(b) by 0 days.

(21) Appl. No.: 10/341,600

(22) Filed: Jan. 14, 2003

(65) Prior Publication Data

US 2003/0151345 A1 Aug. 14, 2003

(30) Foreign Application Priority Data

Jan. 23, 2002 (KR) ..... 2002-3854

(51) Int. Cl.[7] ..... H01J 29/80
(52) U.S. Cl. ..... 313/407; 313/402
(58) Field of Search ..... 313/402, 405, 313/406, 407

(56) References Cited

U.S. PATENT DOCUMENTS 6,469,431 B1 10/2002 Suzuki et al.
6,590,328 B2 * 7/2003 Shin et al.
6,642,645 B2 * 11/2003 Kim et al. ..... 313/407
2001/0013750 A1 8/2001 Song et al.

FOREIGN PATENT DOCUMENTS

JP 2000-077007 3/2000

* cited by examiner

*Primary Examiner*—Vip Patel
(74) *Attorney, Agent, or Firm*—Staas & Halsey, LLP

(57) ABSTRACT

A tension mask frame assembly for a color CRT includes a tension mask having an effective area having a plurality of electron beam passing holes and an ineffective area disposed at an edge portion of the effective area, a frame including support members which support opposite side portions of the tension mask so that tension is applied to the tension mask and rigid members which support end portions of the support members to maintain a gap between support members, and at least one weight member installed by a fixing unit to be separated at a predetermined interval in the ineffective area of the tension mask in a lengthwise direction of the tension mask fixed at the frame.

28 Claims, 17 Drawing Sheets

TENSION MASK FRAME ASSEMBLY FOR COLOR CRT

CROSS-REFERENCE TO RELATED APPLICATION

This application claims the benefit of Korean Application No. 2002-3854, filed Jan. 23, 2002 in the Korean Intellectual Property Office, the disclosure of which is incorporated herein by reference.

BACKGROUND OF THE INVENTION

1. Field of the Invention

The present invention relates to a color cathode ray tube (CRT), and more particularly, to a tension mask frame assembly for a color CRT which reduces vibrations of the tension mask supported by the frame.

2. Description of the Related Art

In a typical color CRT, such as that shown in FIG. 1, three electron beams are emitted from an electron gun 3 installed at a neck portion 2 of a funnel 1. The electron beams pass through electron beam passing holes 4*a* of a shadow mask 4 having a color selection function and land on red, greed and blue fluorescent substances of a fluorescent film 6 formed at an inner surface of a panel 5 sealed with the funnel 1. Thus, as the fluorescent substances are excited, an image is formed.

A screen surface of the above color CRT is made flat to widen a view angle and prevent distortion of an image. Accordingly, a mask installed inside a color CRT and having a color selection function must be made flat. Making flat masks is one of the obstacles in the manufacture of flat screen color CRTs.

FIG. 2 shows an example of a tension mask frame assembly for a flat CRT. As shown in the drawing, a tension mask frame assembly for a flat CRT includes a frame having first and second support members 11 and 12 installed parallel to each other. Each of first and second rigid members 13 and 14 have both end portions fixed to corresponding ends of each of the first and second support members 11 and 12. A tension mask 20 has opposite edges thereof (i.e., long sides) that are welded to the support members 11 and 12 so that tension is applied. The tension mask 20 has a plurality of strips 21 which are separated a predetermined distance from one another and each includes slits 22. Adjacent slits 22 within each strip 21 of the tension mask 20 are divided by a real bridge 23 which connect the adjacent slits 22 at a predetermined interval.

In the tension mask frame assembly having the above structure, since the edges of the long sides of the tension mask 20 are fixed to the first and second support members 11 and 12, the short sides of the tension mask 20 are free in a direction Y which is perpendicular to a direction X (i.e., in a perpendicular direction with respect to one side surface of the tension mask 20). Thus, the tension mask 20 supported by the frame 10 can be vibrated by an impact applied from the outside or sound pressure generated by a speaker. The vibration prevents the electron beams emitted from the electron gun 13 from accurately passing through the sits 22. Thus, the amount of the electron beams passing through the slits 22 changes.

Additionally, the mislanding of the electron beams causes a loss of a color or an allochromatic color of the electron beam landing on the fluorescent film, so that a uniform resolution of an image cannot be obtained. In particular, since the inside of a CRT is a vacuum, there is no air resistance and the vibration of the mask continues for a long time. Thus, there needs to be a damper which quickly damps vibrations by converting vibration energy into another energy.

A conventional tension mask frame assembly for reducing vibrations by using the damper operation is disclosed in Japanese Patent Publication No. hei 12-77007. In the disclosed tension mask frame assembly, the amplitude of the short side portion of the tension mask is relatively uniform compared to that of the center portion thereof under the $7^{th}$ tension mask resonance mode. The tension mask frame assembly has a structure in which vibrations are reduced by inserting clips or rings into a non-hole portion at the short side portion of the tension mask.

In the meantime, a tension mask frame assembly to reduce a vibration reduction effect at the center portion of the tension mask and in the direction X has been developed by the Display Device Research LAB of LG-Philips Displays. In the tension mask frame assembly, both end portions of a ball chain are fixedly installed in an ineffective area of a tension mask supported by a rail (fixed to a panel). Here, it is difficult to attach the ball chain to the ineffective area and a satisfactory vibration reduction effect at the center portion cannot be expected.

SUMMARY OF THE INVENTION

To solve the above and other problems, it is an aspect of the present invention to provide a tension mask frame assembly for a color CRT which improves a vibration reduction effect by reducing vibration energy due to a non-elastic collision of the tension mask supported at the frame and further prevents oscillation of an image and improves resolution by preventing a mislanding of an electron beam on the fluorescent film.

It is another aspect of the present invention to provide a tension mask frame assembly for a color CRT which improves a vibration reduction effect in a lengthwise direction of the tension mask supported at the frame.

Additional aspects and advantages of the invention will be set forth in part in the description which follows and, in part, will be obvious from the description, or may be learned by practice of the invention.

To achieve the above and for other aspects, there is provided a tension mask frame assembly for a color CRT which includes a tension mask having an effective area including a plurality of electron beam passing holes through which electron beams pass and an ineffective area disposed at an edge portion of the effective area, a frame including support members which support opposite side portions of the tension mask so that tension is applied to the tension mask and rigid members which support end portions of the support members to maintain a gap between the support members, and at least one weight member installed by a fixing unit to be separated at a predetermined interval in the ineffective area of the tension mask in a lengthwise direction of the tension mask fixed at the frame.

According to an aspect of the present invention, the fixing unit is attached in the ineffective area to be separated a predetermined distance from the surface of the ineffective area and which is capable of vibrating relative to the surface.

According to another aspect of the present invention, a weight per unit area of the weight member is over 10 times a weight per unit area of the tension mask.

BRIEF DESCRIPTION OF THE DRAWINGS

The above and other aspects and advantages of the present invention will become more apparent and more readily appreciated by describing in detail embodiments thereof with reference to the accompanying drawings in which.

DETAILED DESCRIPTION OF THE EMBODIMENTS

Figure 1:
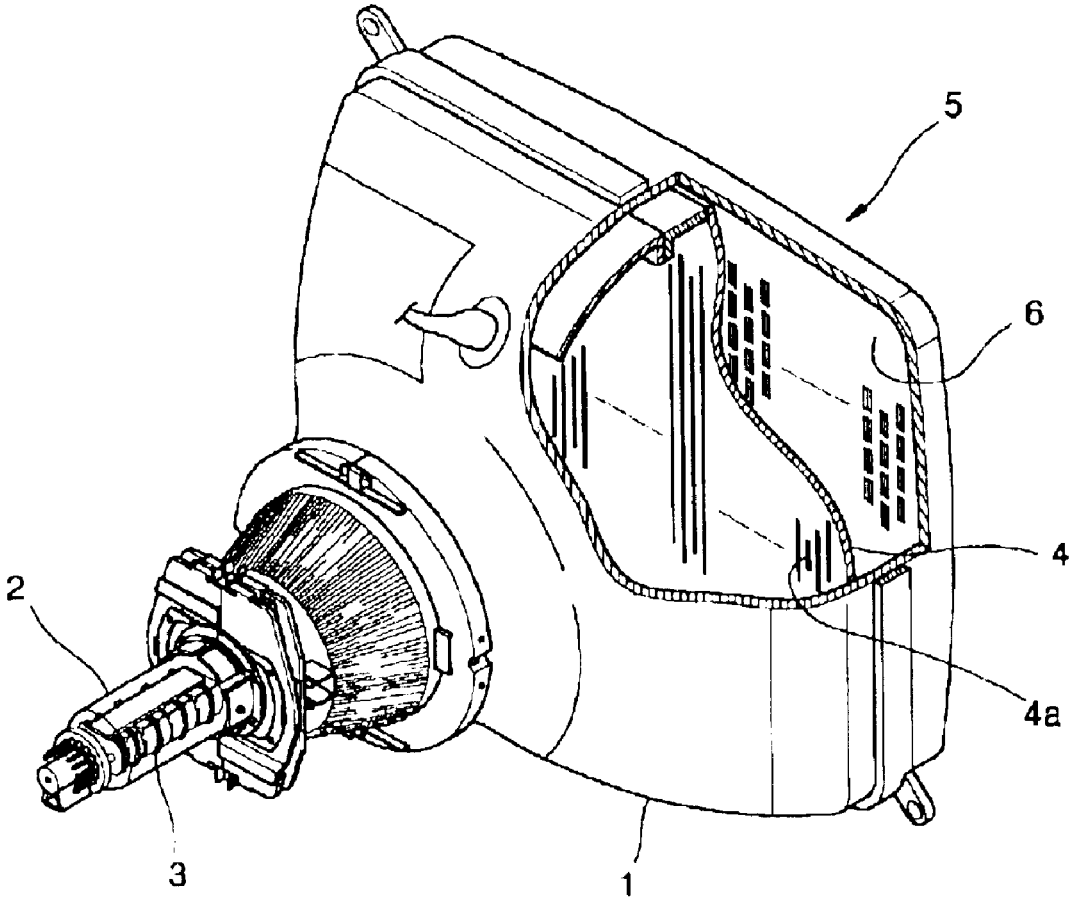
FIG. 1 (PRIOR ART)
FIG. 1 is a partially cut-away perspective view of a conventional CRT.
Figure 2:
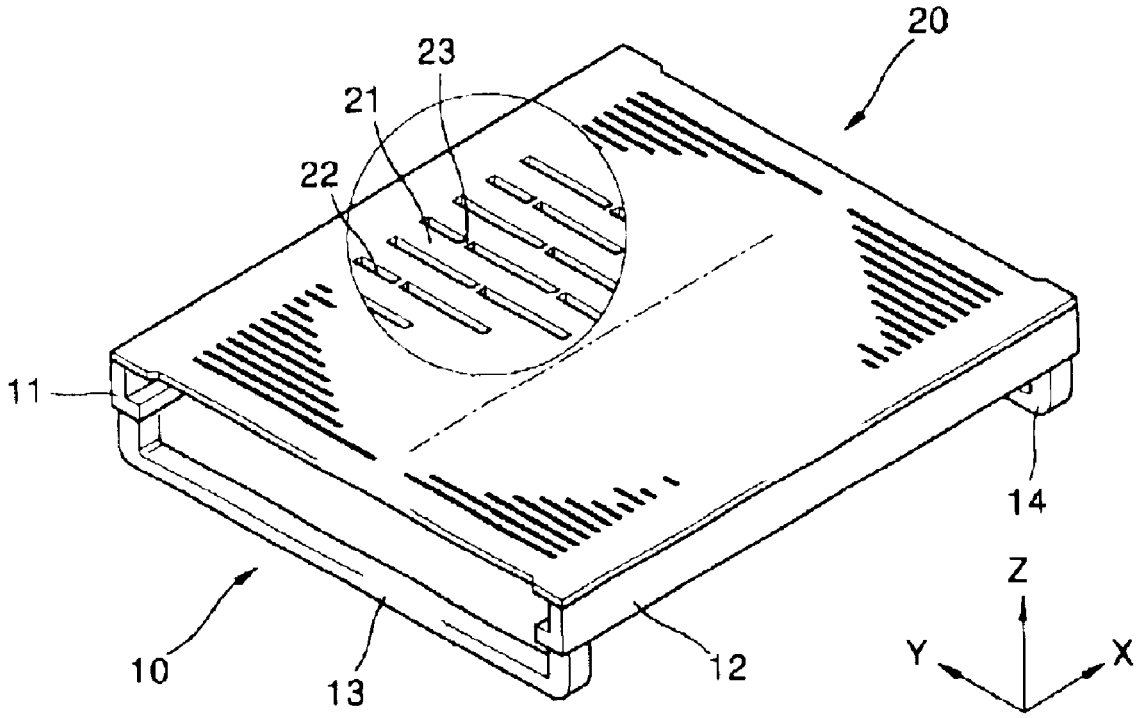
FIG. 2 (PRIOR ART)
FIG. 2 is a perspective view of a conventional tension mask frame assembly.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Another tension mask frame assembly is disclosed in Korean Patent Application No. 2000-6542 and in U.S. patent application Published Ser. No. 2001/0013750A1. In the tension mask frame assembly, both end portions of a tension mask are supported by first and second support members so that a predetermined tension is applied. The tension mask frame assembly includes a vibration prevention member having a strip shape contacting the short side portion of the tension mask in a direction parallel to strips of the tension mask. Also, the tension mask assembly includes at least one damping means installed at a frame and contacting each of the strips of the tension mask. However, since the vibration prevention member and the damping means are installed at the short side portion which is a free end not supported by supports of the conventional tension mask assemblies, a howling phenomenon at the short side portion of the tension mask can be prevented. That is, according to experiments by the present inventor, when a vibration reduction means is attached to the short side portion of the tension mask, it can be seen that a reduction effect can be obtained within a range of 100 mm from the edge, not out of the range. Also, it can be seen that a vibration reduction area in the direction X that is a lengthwise direction of the tension mask is not large. In particular, a vibration reduction effect at the center portion of the tension mask is not great.

Figure 3:
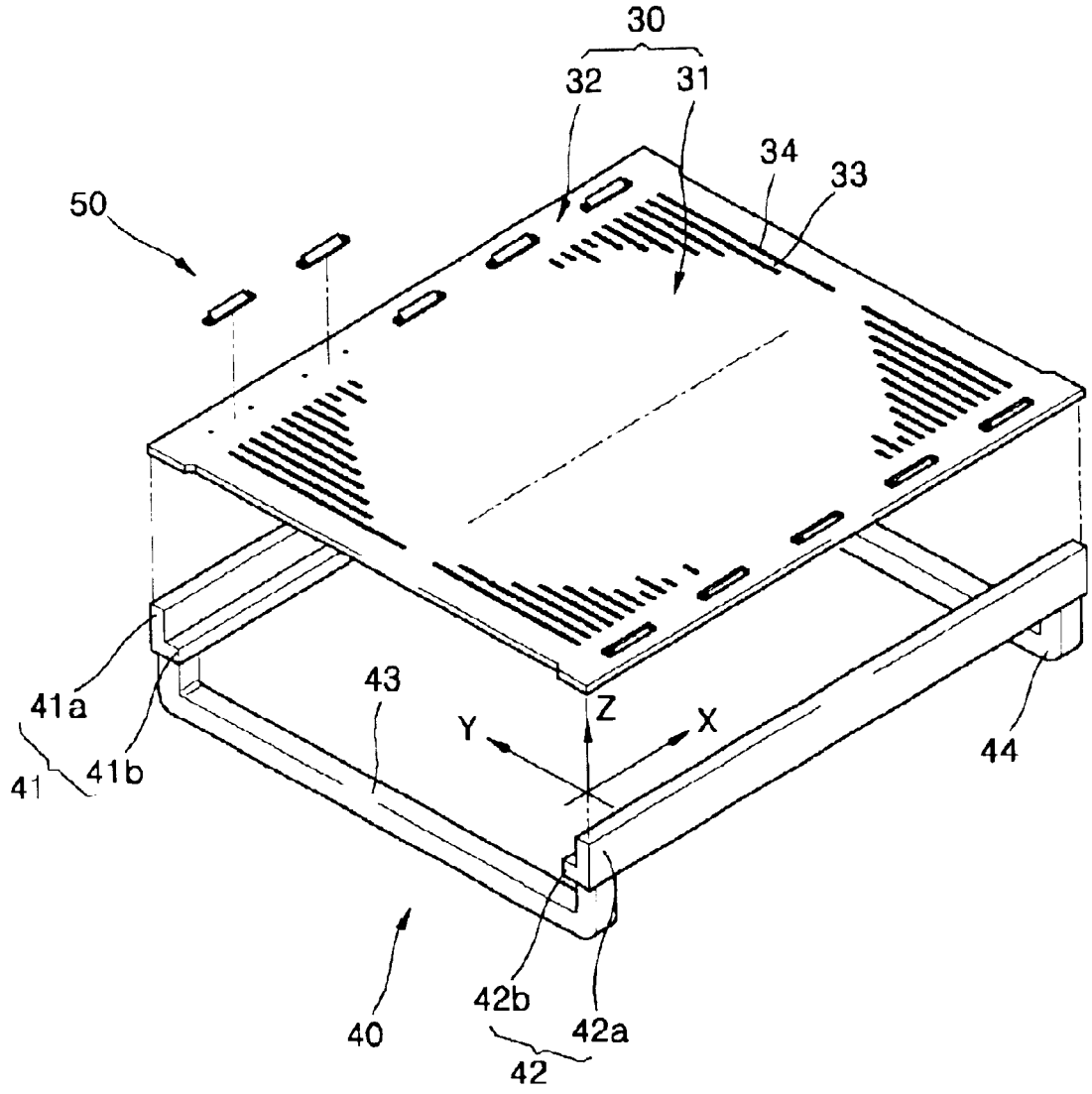
FIG. 3 is an exploded perspective view of a tension mask frame assembly according to an embodiment of the present invention.
Figure 4:
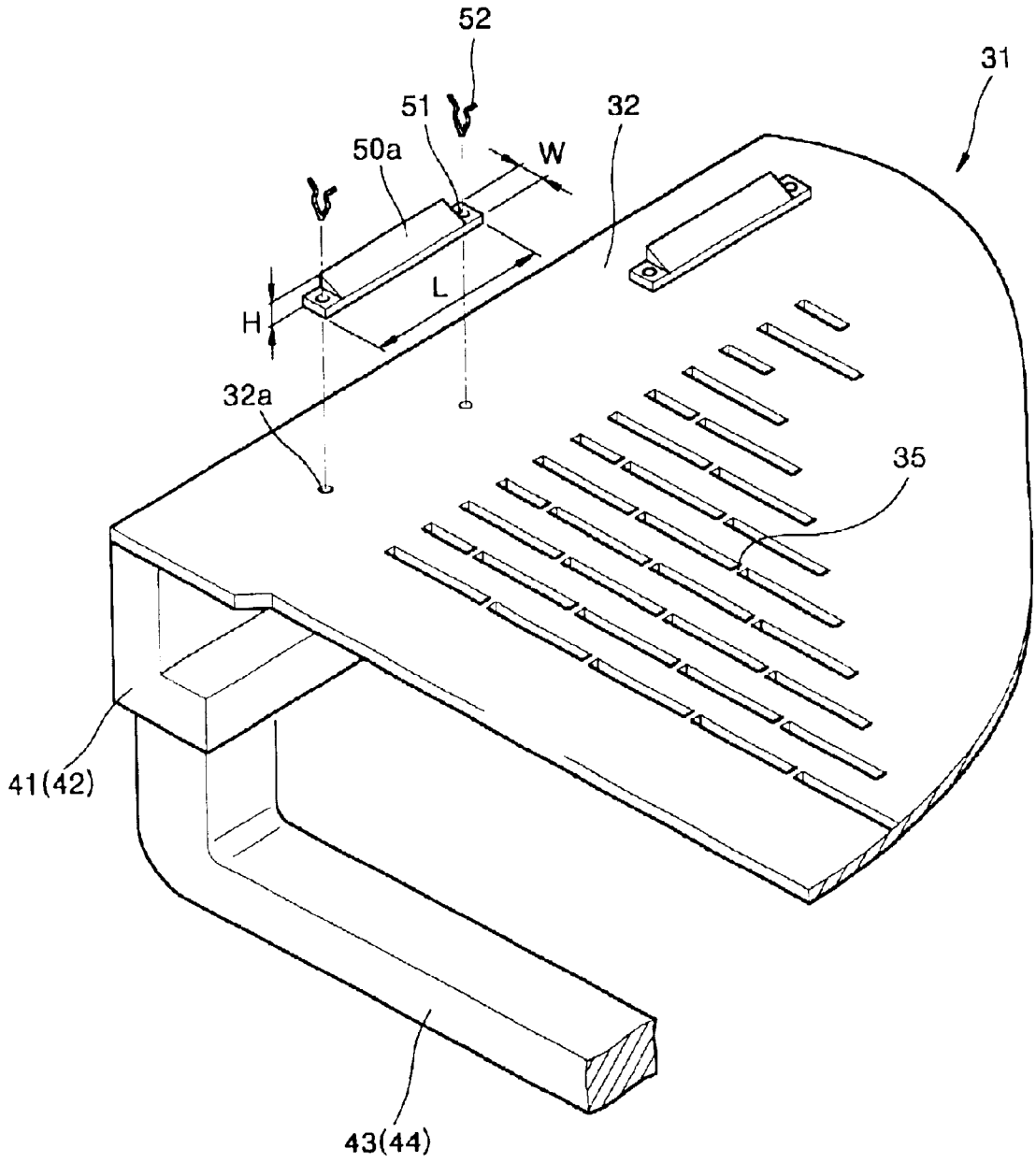
FIG. 4 is a partially cut-away perspective view showing a state in which the weight member shown in FIG. 3 is installed.

FIGS. 3 and 4 show an embodiment of a tension mask frame assembly for a color CRT according to the present invention. As shown in the drawings, the tension mask frame assembly includes a tension mask 30 having electron beam passing holes 34 (slits or through holes having dot shapes) through which electron beams pass. A frame 40 supports a long side portion of the tension mask 30 so that a uniform tension is applied to the tension mask 30 in one direction (hereinafter, referred to as a "direction Y"). A weight member 50 is supported at the frame 40 and is installed in an ineffective area of the tension mask 30 in a lengthwise direction to prevent vibrations of the tension mask 30.

The frame 40 includes first and second support members 41 and 42 separated a predetermined distance from each other. A pair of first and second rigid members 43 and 44 have end portions supported at both side edges of each of the first and second support members 41 and 42. The first and second support members 41 and 42 include fixed portions 41*a* and 42*a* and flange portions 41*b* and 42*b* extending inward from the lower portion of the fixed portions 41*a* and 42*a*, respectively.

Here, although the frame 40 is described to have the first and second support members 41 and 42 and the first and second rigid members 43 and 44 supporting the first and second support members 41 and 42, the present invention is not limited to the above embodiment and any structure capable of applying tension to the tension mask in the direction Y can be used. For instance, the rigid members 43 and 44 supporting the first and second support members 41 and 42 can be fixed at the inner positions off a predetermined distance from end portions of the first and second support members so that a supporting force can be uniform to apply tension to the tension mask 30.

Long side portions of the tension mask 30 are fixed to the first and second fixed portions 41*a* and 42*a* of the frame having the above structure, to which tension is applied. The tension mask 30 includes an effective area 31, where a plurality of slots 34 through which the electron beams pass are formed. The tension mask 30 also includes an ineffective area 32 disposed at the edge of the effective area 31. In the effective area 31 of the tension mask 30, the electron beam passing holes 34 (i.e., slits 34) are formed by a plurality of strips 33 separated a predetermined distance from one another. Real bridges 35 are installed between the slits 43 to connect the adjacent strips 33 and to divide the slits 34. Dummy bridges formed of protrusions (not shown) extending toward each other from the adjacent strips 33 may be formed in the divided slits 34. The shape of the tension mask 30 is not limited to the above-described embodiment.

Figure 5:
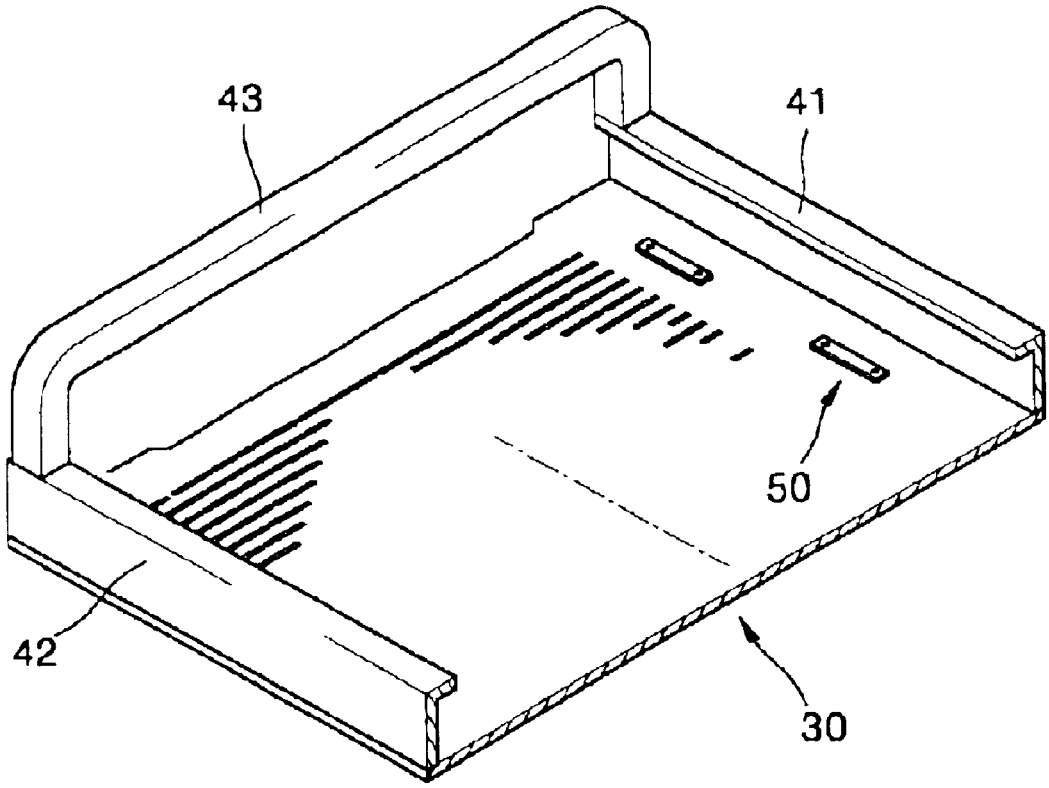
FIG. 5 is a partially cut-away perspective view of the tension mask frame assembly according to an embodiment of the present invention.

The weight member 50 is attached in the ineffective area 32 of the tension mask 30 in the lengthwise direction at a predetermined interval. The weight member 50 is attached on the upper or lower surface of the ineffective area of the tension mask 30, as shown in FIGS. 3 and 5. According to an aspect of the invention, the weight member 50 is formed such that the width W is within 10 mm, the height H is within 8 mm, and the length L is within 5 though 100 mm, considering the size of the ineffective area and a gap from the inner surface of the panel of the CRT.

Figure 6:
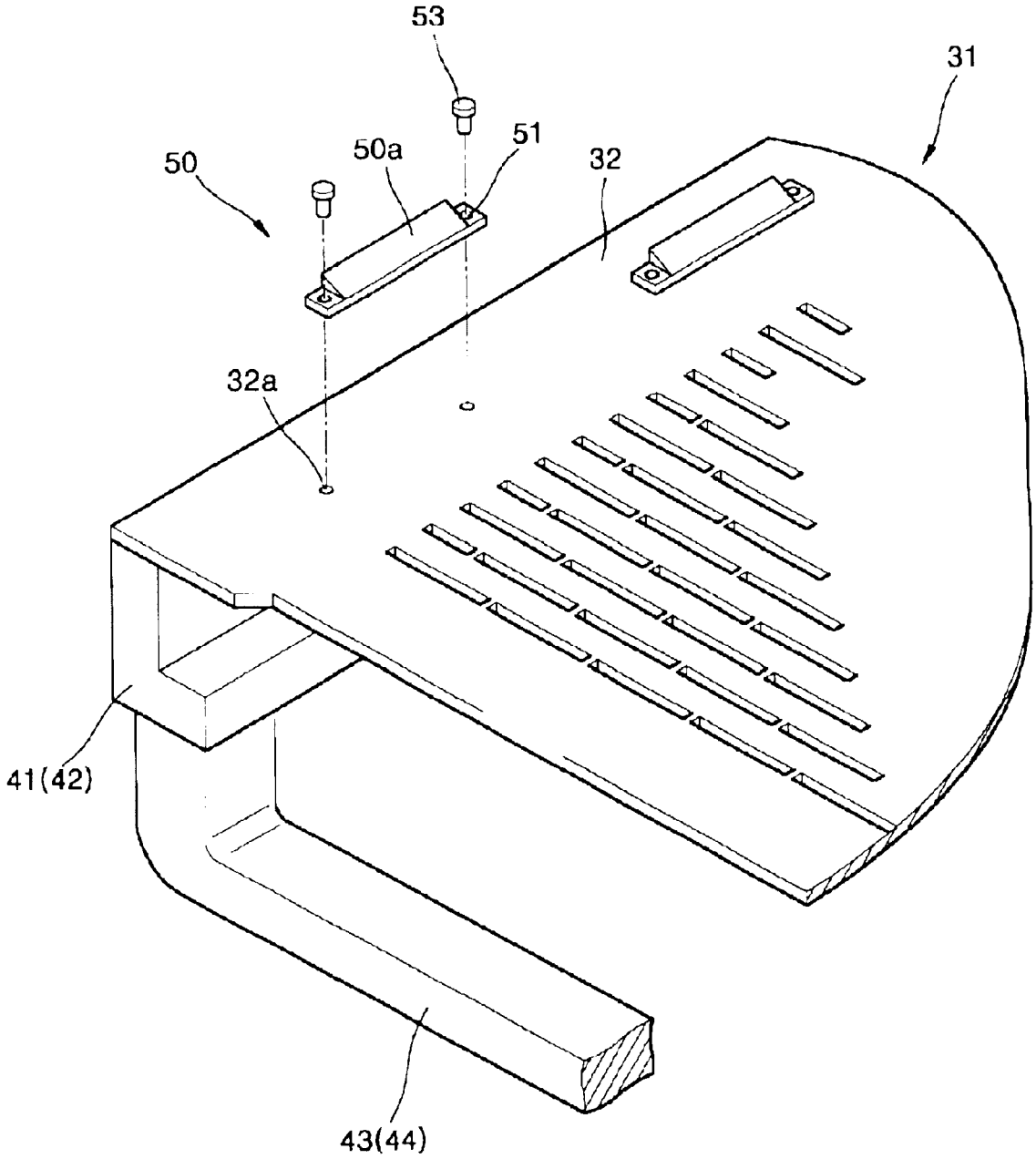
FIG. 6 a partially cut-away perspective view showing another example of a fixing unit which attaches the weight member to the tension mask.

According to an aspect of the invention, the weight member 50 is a bar. The bar is a metal piece formed in strip or having a predetermined length. As shown in FIGS. 4 and 6, the weight member 50 has an inclined surface 50*a* inclined in a direction in which the electron beams proceed so as to not interfere with the electron beams scanned to a periphery portion of the fluorescent film. The weight of the weight member 50 is over 10 times the weight of the tension mask 30. According to an aspect of the invention, the weight of each weight member 50 is at or between 5 and 40 g, considering the tension of the tension mask 30. Also, the overall weight of all weight members 50 is not exceeding 400 g according to an aspect of the invention.

When the weight member 50 is fixed to the ineffective area 32 of the tension mask 30, the weight member 50 is installed by an additional fixing member which is separated a distance of at or between 0.5 mm and 5 mm above the surface of the ineffective area 32 of the tension mask 30. Thus, during the vibration, the weight member 50 vibrates relative to the surface of the ineffective area 32 of the tension mask 30.

The fixing member, as shown in FIGS. 4 and 6, is a pin 52 or rivet 53 which is coupled to coupling holes 32*a* and 51 respectively formed in the ineffective area 32. The pins 52 or rivets 53 are at both end portions of the weight member 50, respectively, so that the weight member 50 is supported with respect to the ineffective area 32. It is understood that the weight member 50 can have other shapes or be of other materials, such as plastics, that are not transformed at high temperatures (such as above 700° C.) and do not bend or break from impact, and that other mechanisms can be used to affix the weight member 50.

In contrast, the vibration reduction mechanism (not shown) disclosed in Japanese Patent Publication No. 12-7707 and U.S. Pat. No. 6,469,431 is installed at a short side portion of the tension mask 30 supported at the frame 40. The vibration reduction mechanism is formed such that a plate member is supported by a fixed ring or a damping member supported at the rigid member contacts the short side portion of the tension mask 30.

The operation of the tension mask frame assembly for a color CRT having the above structure according to the present invention is described below. In the tension mask frame assembly, the long side portions of the tension mask 30 are welded to the fixed portions 41*a* and 42*a* of the first and second support members 41 and 42 such that the first and second support members 41 and 42 are pressed in the opposite directions to each other. As such, the first and second rigid members 43 and 44 supporting the first and second support members 41 and 42 elastically deform and tension is applied to the tension mask 30 in the direction Y in which the strips 33 are arranged.

When the tension is applied as above and a physical impact or sound pressure of a speaker is applied to the tension mask frame assembly installed in the CRT, the tension mask 30 vibrates. Here, since the weight members 50 are installed in the ineffective area 32 of the tension mask 30, the vibrations in the lengthwise direction of the tension mask 30 can be reduced. That is, the weight per unit area of the weight member 50 is relatively greater than the weight per unit area of the tension mask 30. Thus, the amplitude in the direction X efficiently reduces low frequency vibrations while the amplitude in the direction Y efficiently reduces low frequency vibrations.

Since the weight member 50 supported by the fixing mechanism in the ineffective area 32 is installed to be relatively capable of vibrating, a vibration in which the amplitude in the direction X is relatively great is reduced as the ineffective area 32 frictionally contacts the weight member 50.

The operation and effects of the present invention will be further clarified through the following impact tests carried out by the inventor.

Test 1

In this test, an impact was applied to a CRT by dropping a weight from 50 cm above a tension mask frame assembly where the weight members are not attached in the ineffective area of a 32-inch tension mask. The resulting state of the vibrations of the tension mask was measured at the positions which are 200 mm and 300 mm off from the left and right ends of the tension mask. The results of the measurement are shown in the graphs of FIGS. 7 through 10.

Next, a weight member formed of stainless steel and having a weight of 20 g, a thickness of 7.5 mm, a width of 10 mm, and a length of 100 mm was attached to the tension mask frame assembly having the above conditions. A test was carried out under the above conditions to measure the vibrations at the same positions descried above. The results of the test are shown in the graphs of FIGS. 11 through 14.

Figure 7:
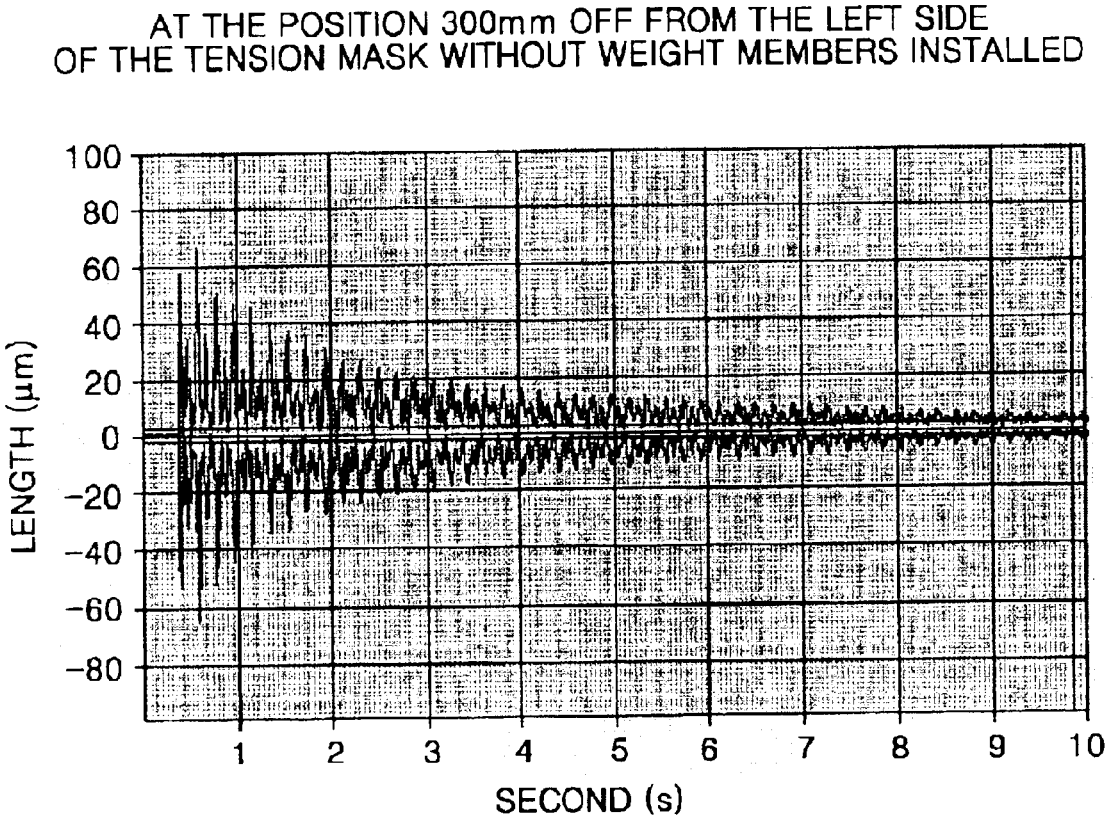
FIGS. 7 through 10 are graphs showing the relationship between vibration and time in the tension mask where the weight member is not attached to the tension mask.
Figure 8:
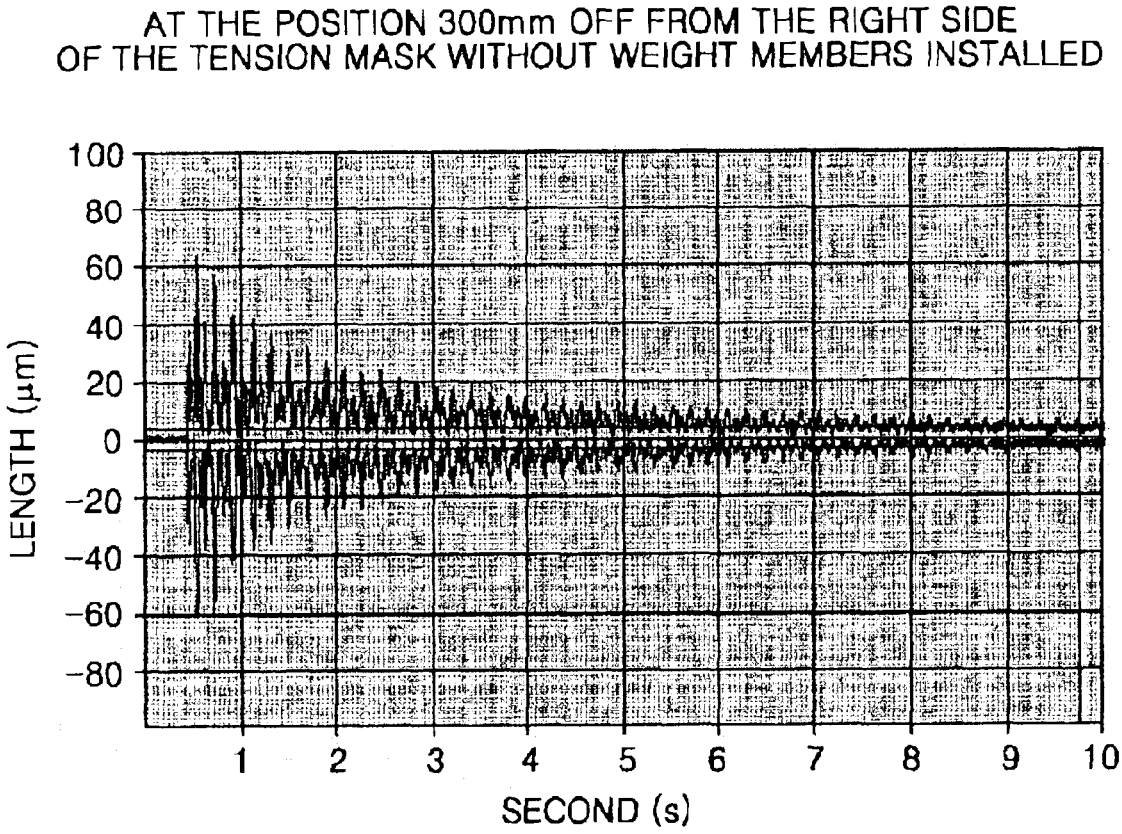
Figure 11:
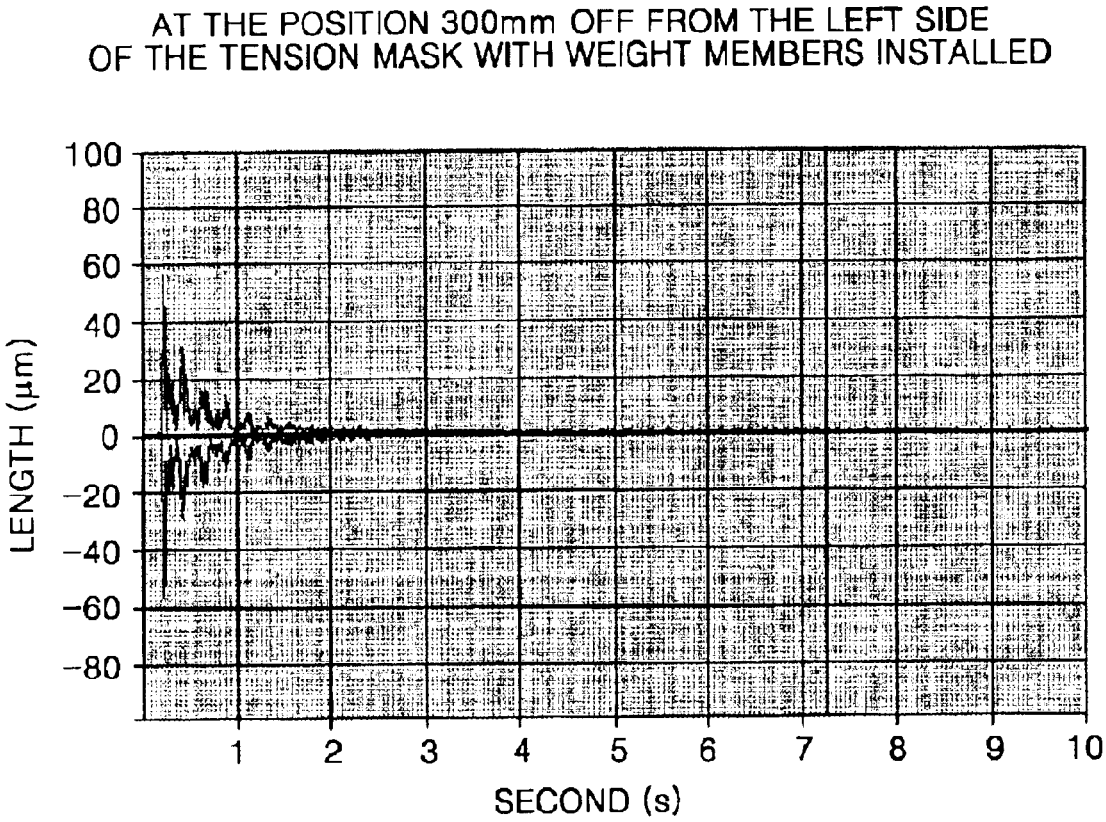
FIGS. 11 through 14 are graphs showing the relationship between vibration and time in the tension mask where the weight member is attached to the tension mask.
Figure 12:
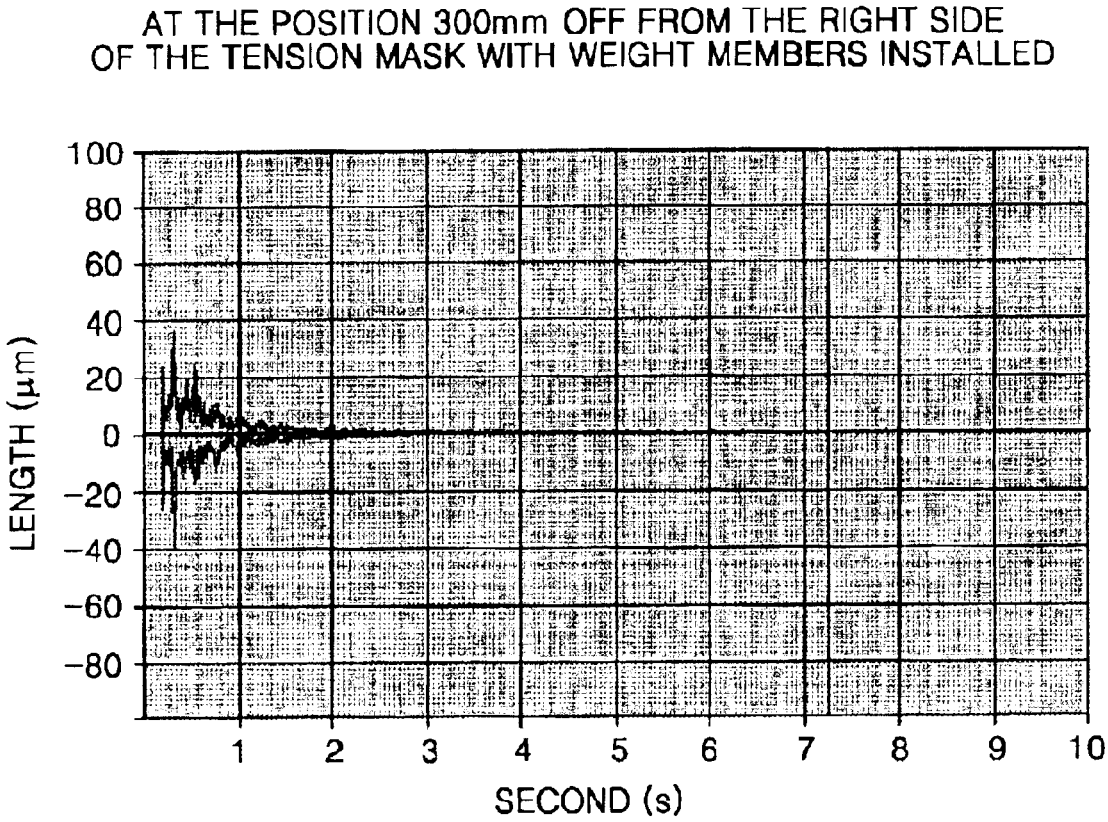

Referring to the FIGS. 11 through 14, where the weight member is attached as shown in FIGS. 11 and 12, the vibrations were reduced such that the amplitude was within ±20 $\mu$m within 1 second at the positions 300 mm off from the left and right ends of the support bar. In contrast, where no weight member is attached as shown in FIGS. 7 and 8, it takes more than 3 seconds for the amplitude to reduce to within ±20 $\mu$m at these same positions.

Figure 9:
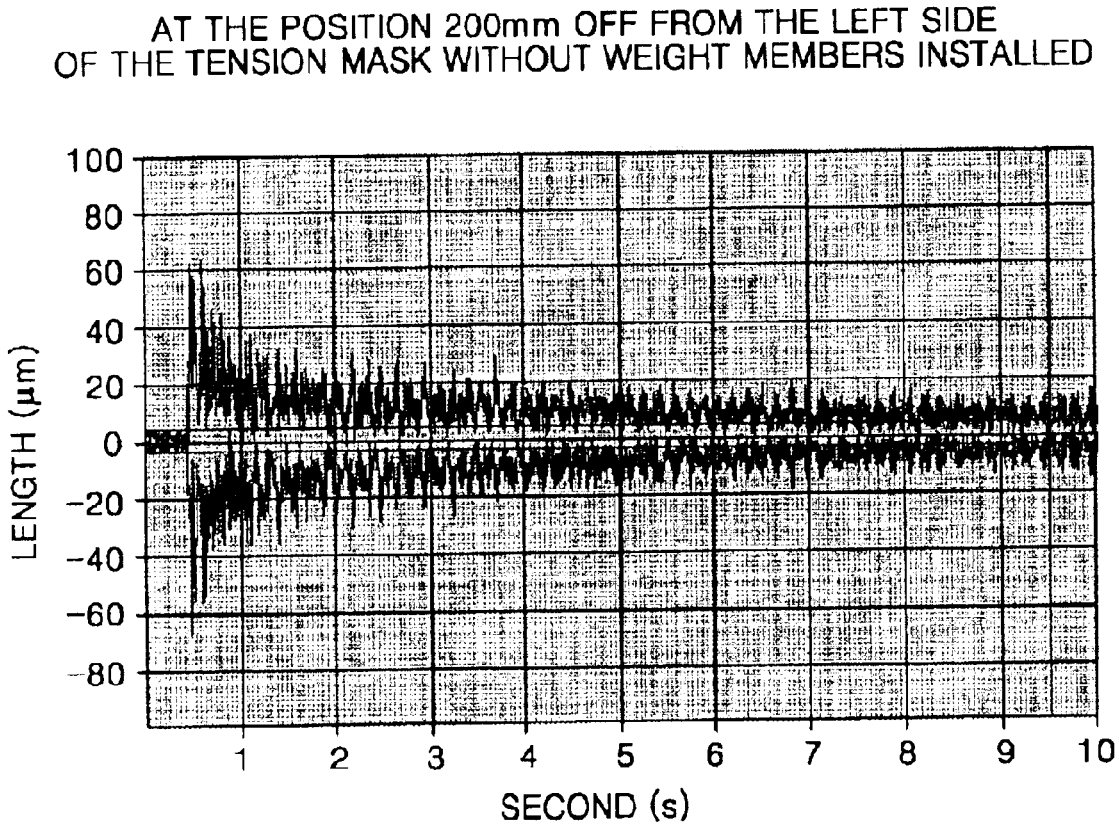
Figure 10:
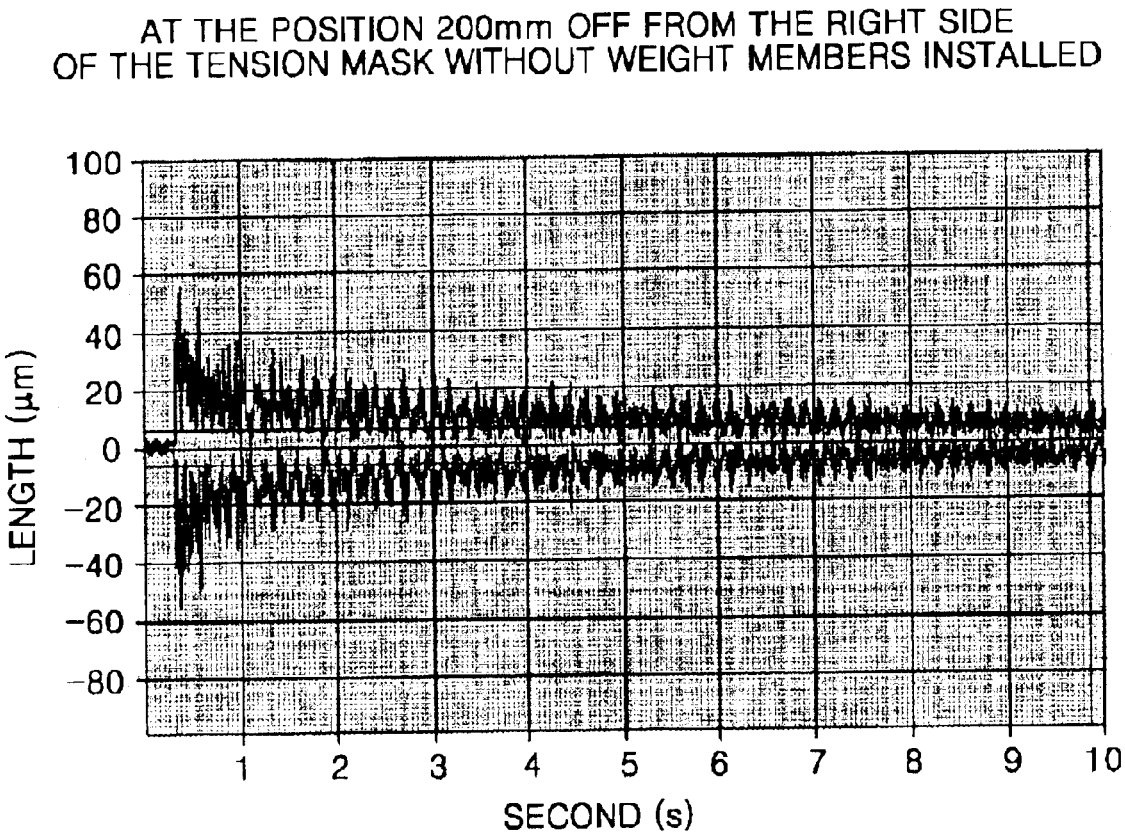
Figure 13:
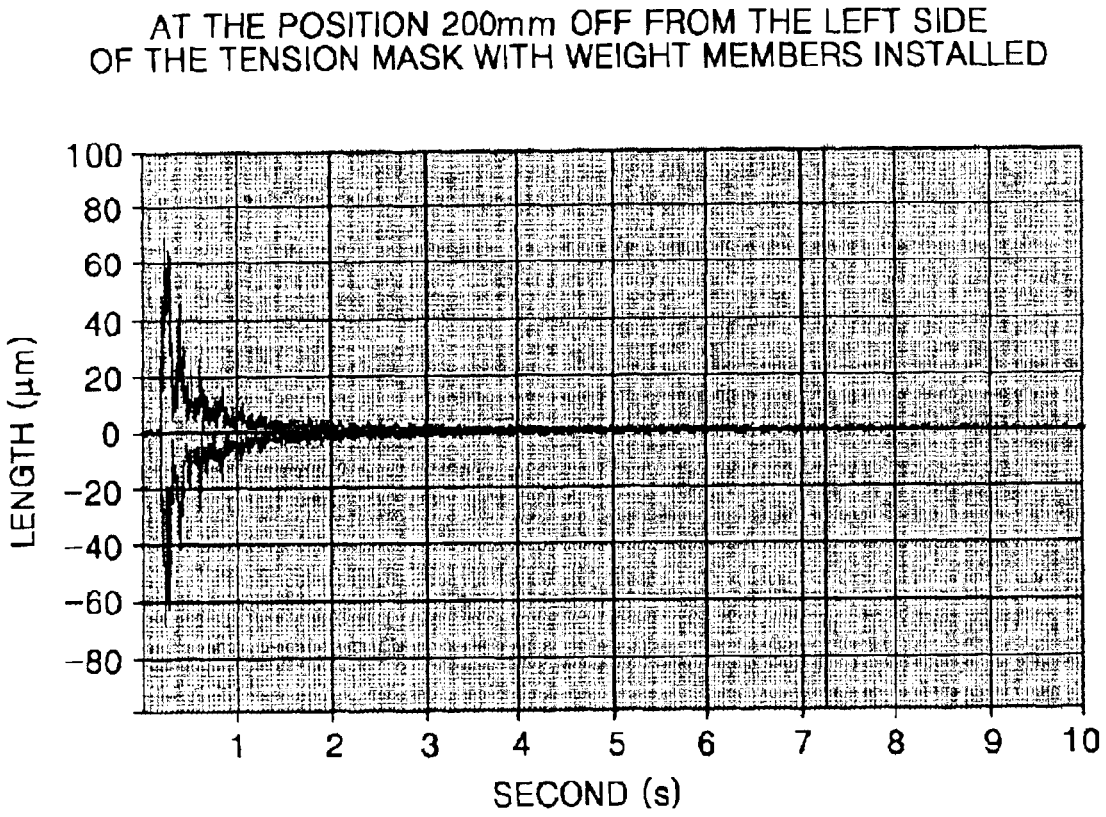
Figure 14:
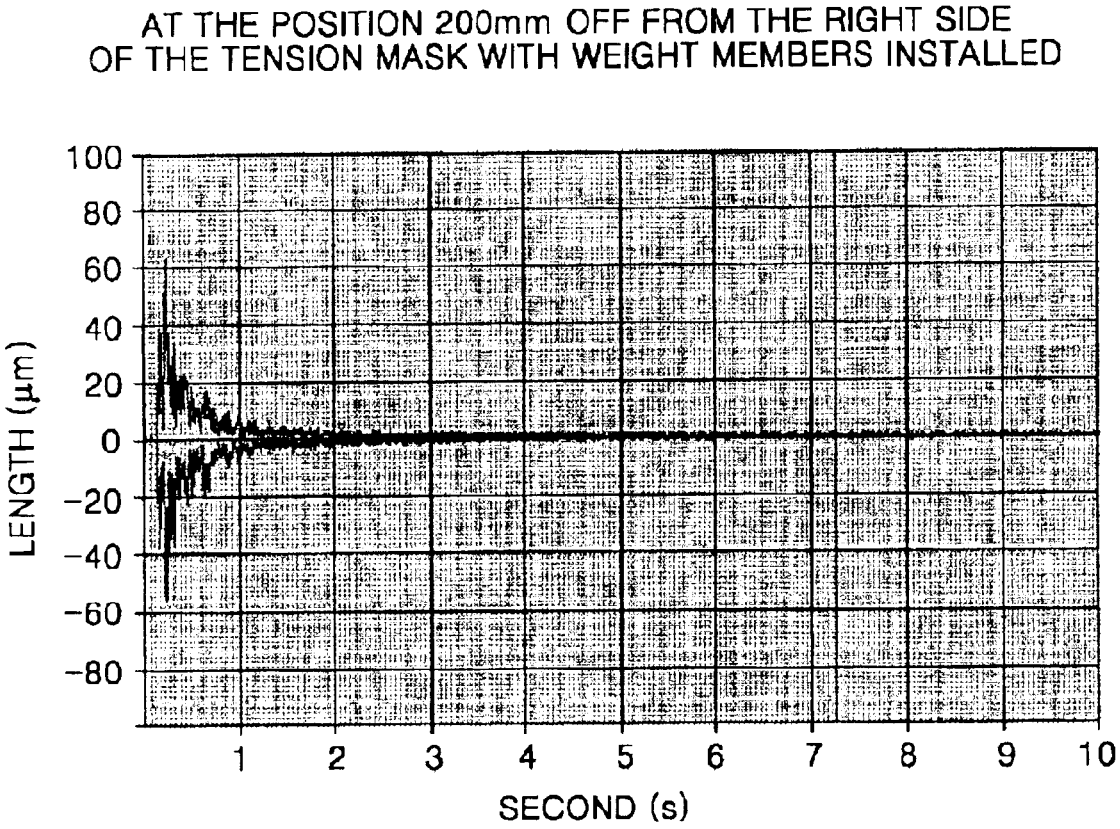

At the 200 mm off positions from the left and right sides, where the weight member was attached, as shown in FIGS. 13 and 14, the amplitude was reduced to within ±20 $\mu$m within 1 second. In contrast, where no weight member was attached, as shown in FIGS. 9 and 10, it takes more than 4 seconds for the amplitude to be reduced within ±20 $\mu$m and that remaining vibration continues.

Test 2

Figure 15:
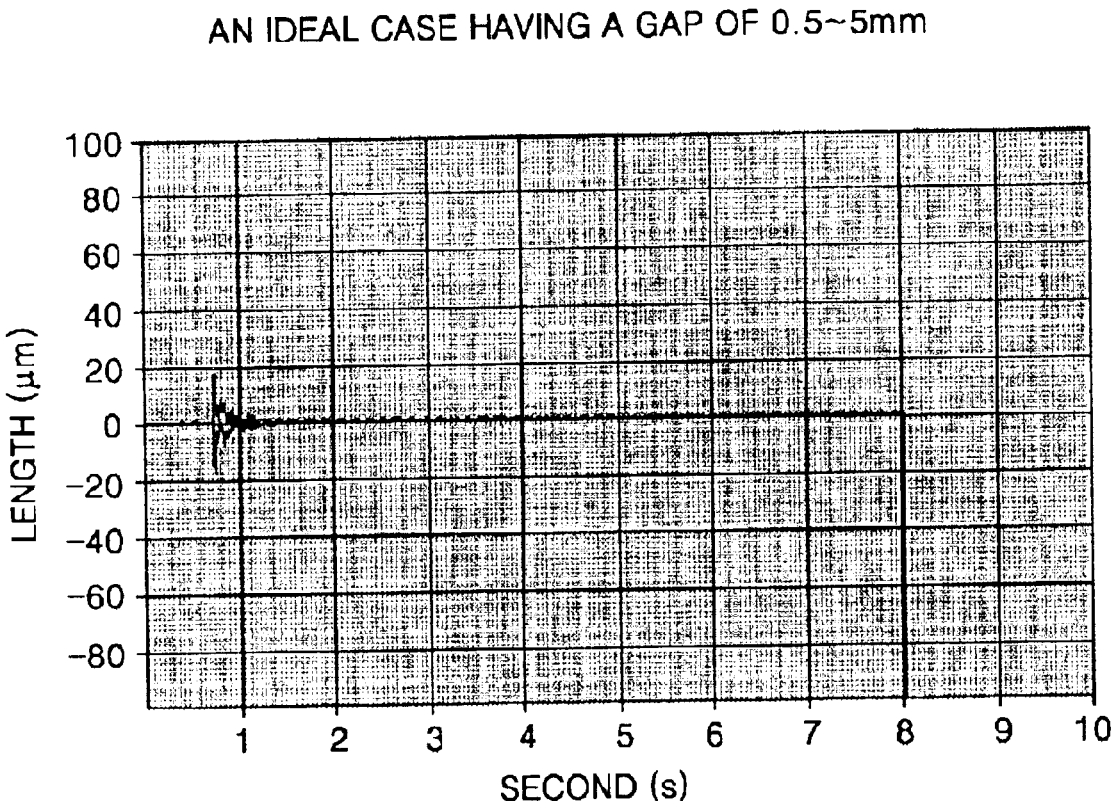
FIGS. 15 through 17 are graphs showing the relationship between vibration reduction and the interval between the weight member and the ineffective area surface of the tension mask.
Figure 16:
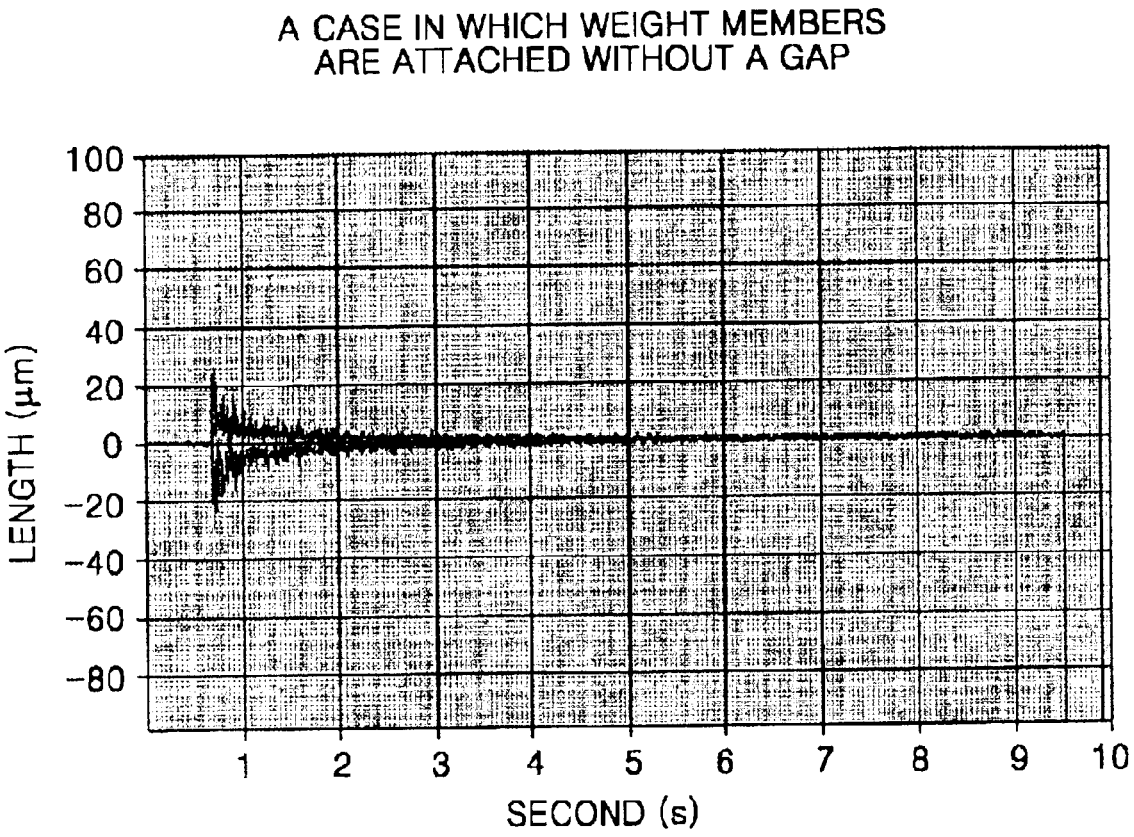
Figure 17:
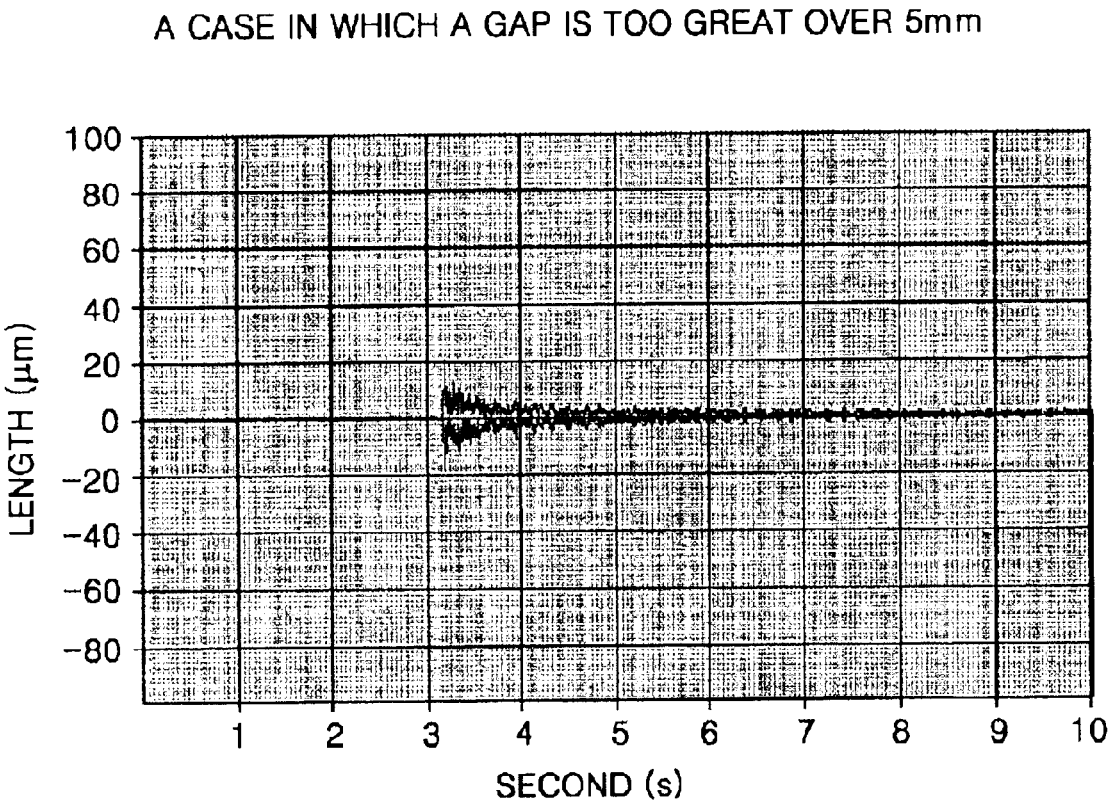

In this test, under the same conditions in Test 1, the relationship between a gap between the weight member fixed by a fixing mechanism in the ineffective area of the tension mask and the surface of the ineffective area of the tension mask and vibration reduction time was measured and the results thereof are shown in the graphs of FIGS. 15 through 17.

As shown in the graphs, it can be seen that the vibration reduction time where the weight member was within 0.5 through 5 mm off from the ineffective area is shorter than where the weight member was fixed in the ineffective area or maintained to be separated more than 5 mm from the surface of the ineffective area.

As described in the above, in the tension mask frame assembly for a color CRT according to the present invention, since the weight members are installed using the fixing mechanism in the ineffective area of the tension mask at which the tension mask is welded at the edge of the first and second support members, the vibration of the tension mask can be prevented. Further, oscillation of an image due to the vibration of the tension mask can be prevented.

While this invention has been particularly shown and described with reference to embodiments thereof, it will be understood by those skilled in the art that various changes in form and details may be made therein without departing from the spirit and scope of the invention as defined by the appended claims and equivalents thereof.

What is claimed is:

1. A tension mask frame assembly for a color CRT comprising:

a tension mask having an effective area in which a plurality of electron beam passing holes through which electron beams pass are formed, and an ineffective area disposed at an edge portion of the effective area;

a frame including support members which support opposite side portions of the tension mask lengthwise so that tension is applied to the tension mask, and rigid members which support end portions of the support members to maintain a gap between the support members; and a weight member attached to the tension mask using a fixing unit and which is separated at a predetermined interval above the ineffective area of the tension mask, the weight member being attached in at the ineffective area in the lengthwise direction of the tension mask.

2. The assembly as claimed in claim 1, wherein the weight member is installed on an inner surface of the ineffective area which faces the frame.

3. The assembly as claimed in claim 1, wherein the fixing unit includes a pin or rivet which is coupled to a through hole in the weight mask and the ineffective area of the tension mask so as to support the weight member with respect to the tension mask.

4. The assembly as claimed in claim 1, wherein a weight per unit area of the weight member is over 10 times a weight per unit area of the tension mask.

5. The assembly as claimed in claim 1, wherein the weight of the weight member is at or between 5 and 50 g.

6. The assembly as claimed in claim 1, wherein the weight member has an inclined surface inclined in a direction in which the electron beam proceeds so as to prevent interference with the electron beams.

7. A tension mask assembly comprising:

a tension mask having electron beam passing holes and opposite sides extending in a first direction;

a frame which supports the tension mask at the opposite sides and which applies tension to the tension mask in a second direction other than the first direction; and a weight unit disposed in the first direction at a periphery of the tension mask adjacent the opposite sides so as to allow electron beams to pass through the electron beam passing holes.

8. The assembly of claim 7, wherein the weight unit comprises weight members arranged in rows adjacent corresponding sides of the tension mask and extending in the first direction, and the electron beam passing holes are between the rows.

9. The assembly of claim 7, wherein the weight unit is attached to the tension mask so as to vibrate relative to the tension mask.

10. The assembly of claim 9, wherein the weight unit comprises weight members, and each of the weight members is supported above the tension mask.

11. The assembly of claim 10, further comprising clips which support each of the weight members above the tension mask.

12. The assembly of claim 10, further comprising pins which support each of the weight members above the tension mask.

13. The assembly of claim 10, wherein each of the weight members has a shape which is longer in the first direction than in the second direction, and has a sloped surface having a height which increases away from the tension mask according to a proximity to a corresponding one of the opposite sides of the tension mask.

14. The assembly of claim 9, wherein the weight unit is supported above a surface of the tension mask by a height at or between 0.5 and 5 mm.

15. A color cathode ray tube comprising:

a funnel having a neck portion;

an electron gun attached to the neck portion so as to emit electron beams through the funnel;

a panel sealing the funnel to create a vacuum and having a fluorescent film disposed in the vacuum so as to receive the emitted electron beams; and a tension mask assembly through which the electron beams pass between the electron gun and the fluorescent film, the assembly comprising:

a tension mask having electron beam passing holes and opposite sides extending in a first direction;

a frame which supports the tension mask at the opposite sides and which applies tension to the tension mask in a second direction other than the first direction; and a weight unit disposed in the first direction at a periphery of the tension mask adjacent the opposite sides so as to allow the electron beams to pass through the electron beam passing holes.

16. The tube of claim 15, wherein the weight unit comprises weight members arranged in rows adjacent corresponding sides of the tension mask and extending in the first direction, and the electron beam passing holes are between the rows.

17. The tube of claim 15, wherein the weight unit is attached to the tension mask so as to vibrate relative to the tension mask.

18. The tube of claim 17, wherein the weight unit comprises weight members, and each of the weight members is supported above the tension mask.

19. The tube of claim 18, further comprising clips which support each of the weight members above the tension mask.

20. The tube of claim 18, further comprising pins which support each of the weight members above the tension mask.

21. The tube of claim 18, wherein each of the weight members has a shape which is longer in the first direction than in the second direction, and has a sloped surface having a height which increases away from the tension mask according to a proximity to a corresponding one of the opposite sides of the tension mask.

22. The tube of claim 17, wherein the weight unit is supported above a surface of the tension mask by a height at or between 0.5 and 5 mm.

23. A tension mask assembly comprising:

a tension mask having electron beam passing holes and opposite sides;

a frame which supports the tension mask at the opposite sides and which applies tension to the tension mask; and a weight unit disposed at a periphery of the tension mask adjacent the opposite sides so as to allow electron beams to pass through the electron beam passing holes, wherein the weight unit has a shape which is longer in a first direction than in a second direction, and has a sloped surface having a height which increases away from the tension mask according to a proximity to a corresponding one of the opposite sides of the tension mask.

24. The tension mask assembly of claim 23, wherein the weight unit is supported above a surface of the tension mask by a height at or between 0.5 and 5 mm.

25. The tension mask assembly of claim 24, further comprising a clip which supports the weight unit above the tension mask.

26. The tension mask assembly of claim 24, further comprising pins which support each of the weight members above the tension mask.

27. The tension mask assembly of claim 23, wherein the weight unit is attached to the tension mask so as to vibrate relative to the tension mask.

28. The tension mask assembly of claim 23, further comprising additional weight units arranged in rows adjacent corresponding sides of the tension mask and extending in the first direction, wherein:

the electron beam passing holes are between the rows, the opposite sides of the tension mask extend in the first direction, and the tension is applied in the second direction.

* * * * *